US005697797A

United States Patent [19]

Wendel

[11] Patent Number: 5,697,797

[45] Date of Patent: Dec. 16, 1997

[54] DEVICE FOR GROUNDED SECURING OF AN ELEMENT AT A HOLE IN A METAL PLATE

[75] Inventor: Lars Wendel, Gävle, Sweden

[73] Assignee: RTB AB, Sweden

[21] Appl. No.: 549,842

[22] PCT Filed: Apr. 19, 1994

[86] PCT No.: PCT/SE94/00346

§ 371 Date: Oct. 18, 1995

§ 102(e) Date: Oct. 18, 1995

[87] PCT Pub. No.: WO94/25998

PCT Pub. Date: Nov. 10, 1994

[30] Foreign Application Priority Data

Apr. 29, 1993 [SE] Sweden ..... 9301455

[51] Int. Cl.[6] ..... H01R 4/66

[52] U.S. Cl. ..... 439/92; 439/939; 411/60; 411/342

[58] Field of Search ..... 439/92, 927, 939; 411/60, 55, 340–342

[56] References Cited

FOREIGN PATENT DOCUMENTS 26 16 968 C2 12/1982 Germany .

*Primary Examiner*—Gary F. Paumen

*Attorney, Agent, or Firm*—Zarley, McKee, Thomte, Voorhees, & Sease

[57] ABSTRACT

A device for grounded securing of an element (1) at a hole (9) in a metal plate (10) comprises members (6, 13) movable on both sides of the plate towards each other and the plate for securing the element to the plate and means (12) adapted to establish an electrical connection between the metal of the plate and the element. These means (12) are arranged to enter into radial abutment on the circumferential wall (27) of the hole while establishing said electrical connection.

19 Claims, 3 Drawing Sheets

DEVICE FOR GROUNDED SECURING OF AN ELEMENT AT A HOLE IN A METAL PLATE

FIELD OF THE INVENTION AND PRIOR ART

The present invention relates to a device for grounded securing of an element at a hole in a metal plate.

Thus, to ground means here that the element in question is brought into electrical connection with the metal of the plate, in which the hole is made. The invention relates to such grounded securing of all types of elements, for which there is a desire to obtain such a securing, but the case of an antenna securing element intended to be secured in the hole in the body sheet of a car for a radio antenna, in particular for a car telephone, will by way of example be discussed hereinafter.

For the good function of such an antenna, and also other elements of a similar type, the resistance to ground, i.e. in this case the car sheet, of the antenna securing point has to be very low. Such a grounded securing of an antenna to the car sheet has until now been carried out by either exposing the metal plate or sheet on the inside of the car, i.e. most frequently on the underside of the car ceiling, around said hole, so that the securing member located inside the car may enter into electrical contact generating abutment upon the metal plate and establish an electrical connection therebetween and the antenna securing element, or the car enamel may be removed from the surfaces surrounding the hole and located on the outer side of the metal plate, so that the securing member externally located may come into an electric contact generating abutment upon these surfaces and thereby achieve an electrical connection between the metal plate and said element. The mechanic has in the former case great difficulties, since he has to assume a very uncomfortable working position and often has to stretch his arm about one meter and at the same time handle a tool to be rotated and pulled upwardly. It may thereby easily happen that the result, i.e. the grounding, becomes imperfect. In the latter case it is, besides requirements of accuracy and patience during the mounting, a great risk for damaging or in any case influencing the surrounding enamel, so that moisture later on penetrates thereunder and "roses" are created around the antenna location followed by corrosion on the metal plate thereunder.

BRIEF DESCRIPTION OF THE INVENTION

The object of the present invention is to provide a device of the type mentioned in the introduction, which enables grounded securing of an element at a hole in a metal plate, especially but not exclusively an antenna securing element at a hole in a car body sheet or plate, which finds a remedy to the inconveniences mentioned above of already known devices of this kind.

Thanks to the fact that said means are adapted to enter into radial abutment on the circumferential wall of the hole while establishing said electrical connection, it is not necessary to expose the metal of the plate neither on the inner side nor on the outer side thereof before securing the element, and no other exposure of any portions of the metal plate are either required, since the metal surfaces of the plate already exposed by producing the hole are used for obtaining the grounding aimed at. This means a greater simplicity as well as an improved result of the mounting with respect to devices already known. When securing the element to the plate it is only necessary to displace said means into a good radial contact with the circumferential wall of the hole and move the securing members towards each other into the securing position for completing the mounting in a satisfying manner. With respect to the case discussed above of mounting an antenna for a car telephone, the mounting gets much simplier, the risks for sheet damages caused by the mounting, for instance through corrosion, are eliminated and a very good electrical connection between the antenna securing element and the metal of the plate may be obtained with a high reliability.

According to a preferred embodiment of the invention said means comprise portions arranged to be displaced radially inside said hole into abutment upon the circumferential wall of the hole. Said means may thereby by the portions in question easily be brought into the hole, since this may be accomplished with a certain clearance, whereupon the portions may be brought to move in a radial direction so as to obtain the abutment required, so that the mounting work is very easy. According to a further preferred embodiment of the invention said means are arranged to enter into said abutment by displacing the securing members in the direction towards each other. Even this characteristic contributes to simplifying the mounting work, and a combination of this embodiment and the preceding one is particularly advantageous.

According to still a further preferred embodiment of the invention said means are designed to enter into a preloaded abutment onto said circumferential wall. This is advantageously obtained according to another advantageous embodiment of the invention by producing at least portions of said means of a resilient material. A very good and reliable electrical contact between said means and the metal of the plate may in this way be continuously ensured.

Further advantages and advantageous characteristics of the invention will appear from the following description and the other dependent claims.

BRIEF DESCRIPTION OF THE DRAWINGS

With reference to the appended drawings, below follows a description of a device according to a preferred embodiment of the invention cited as an example. In the drawings.

DETAILED DESCRIPTION OF A PREFERRED EMBODIMENT OF THE INVENTION

Figure 1:
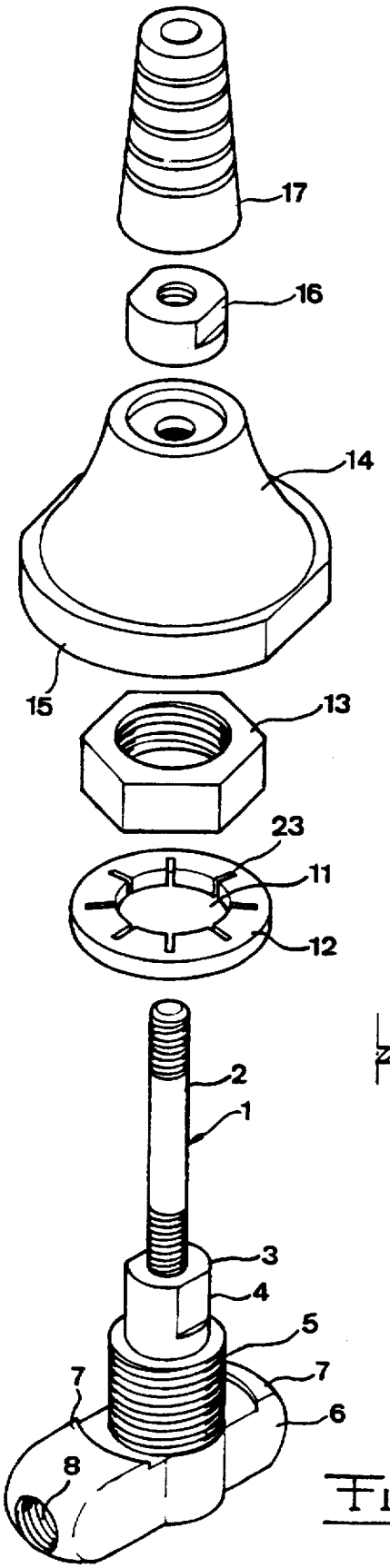
FIG. 1 is an exploded view of a preferred embodiment of the device according to the invention applied to an antenna, in particular for car telephones.

FIG. 1 shows an elongated element 1, on which an antenna radiator is intended to be secured and which is intended to be secured at a hole in a metal plate. The element 1 has an upper cylindrical thinner portion 2, which is electrically conductive and to the upper end of which an antenna radiator not shown is intended to be secured. The element 1 has further an intermediate portion 3 of an electrically insulating material, such as plastic, and which has an intermediate thickness and is provided with chamferings 4 for holding it by a wrench or similar tool, as well as a lower, electrically conductive, thicker portion 5. The definition of the upper and lower portions may of course be inverted should the element be arranged with the portion here called the upper portion downwardly. The lower, thicker portion 5 is sleeve-like, and the intermediate portion 3 extends coaxially through the lower portion 5 to the lower end thereof, and the corresponding circumstance is valid for the upper portion 2, which extends coaxially in the intermediate portion 3 to the lower end of the lower portion 5. Thus, the portions 2, 3 and 5 function together as a coaxial cable, and the portion 2 alternates between being the positive pole and the negative pole of the antenna securing element 1, whereas the portion 5 is the ground part of the latter element. The upper portion 2 has at both ends thereof an outer thread, and the lower portion has over the entire length thereof an outer thread. A first securing member 6 is rigidly secured to the end of the lower portion 5. This member is formed by a piece having considerably greater dimension in at least a transversal direction with respect to the extension of the element than the diameter of the hole at which the element 1 is intended to be secured. The securing member 6 has surfaces 7 directed substantially parallelly to the center line of the element 1 and intended to come into abutment upon those portions of a metal plate which surround the hole mentioned above. The securing member 6 has also a channel 8 for introducing and attaching a suitable coaxial cable to the abovementioned coaxial cable formed by the element 1.

Figure 2:
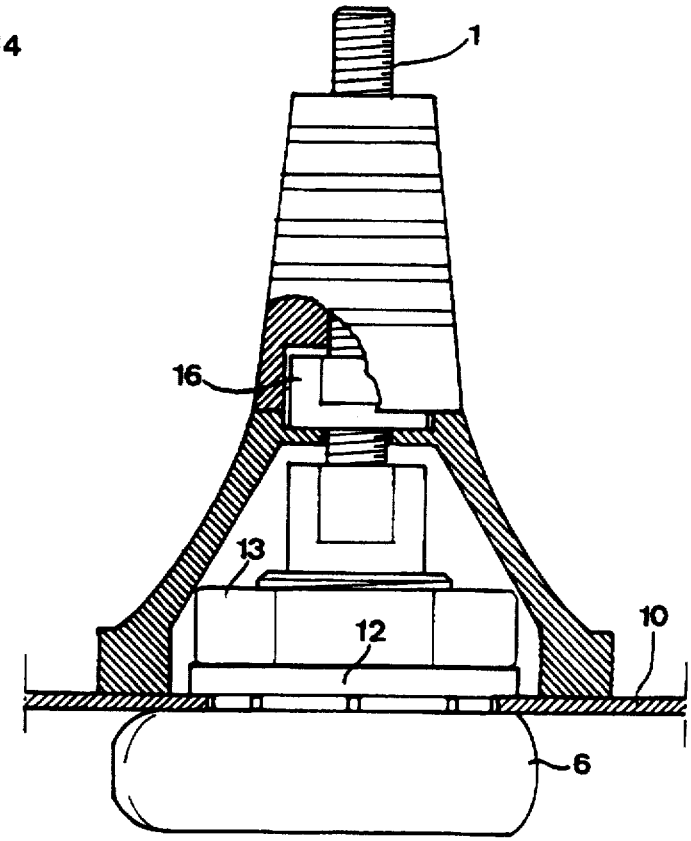
FIG. 2 is a partially sectioned view of the device according to FIG. 2 in a state in which it is secured at a hole in a metal plate, some housing parts being broken away so as to improve the illustration.
Figure 3:
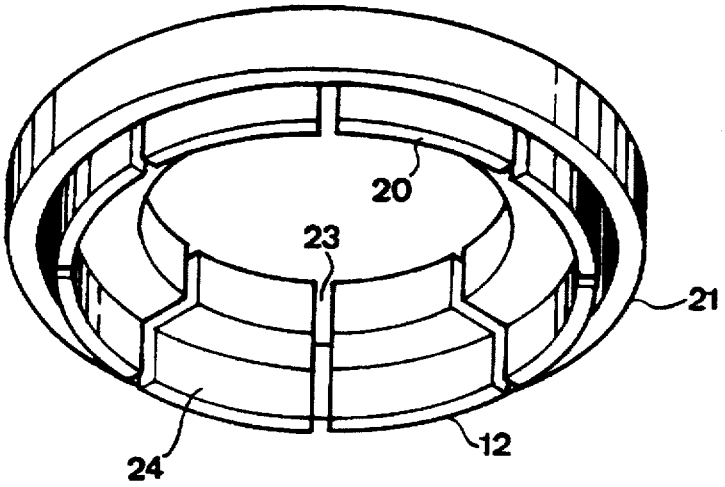
FIG. 3 is an enlarged perspective view of a washer being a part of the means of the device for establishing an electrical connection.
Figure 4:
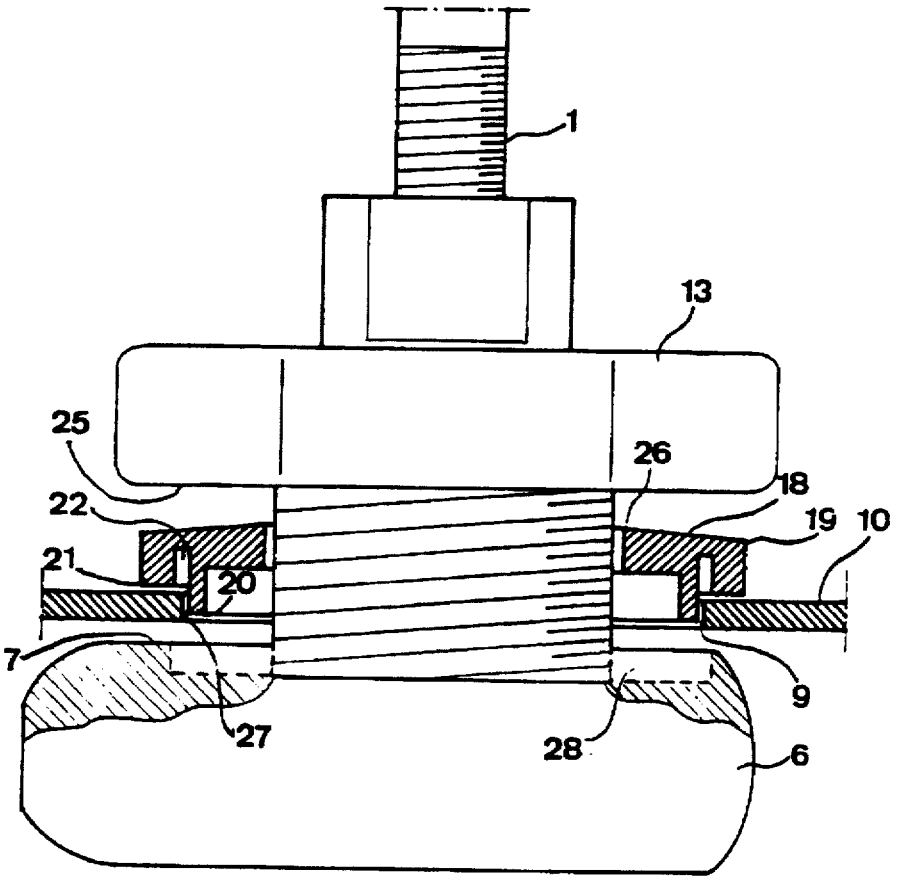
FIG. 4 is a partially sectioned view enlarged with respect to FIG. 2 of the device according to the invention in a state, in which the securing to a metal plate is still not completed.
Figure 5:
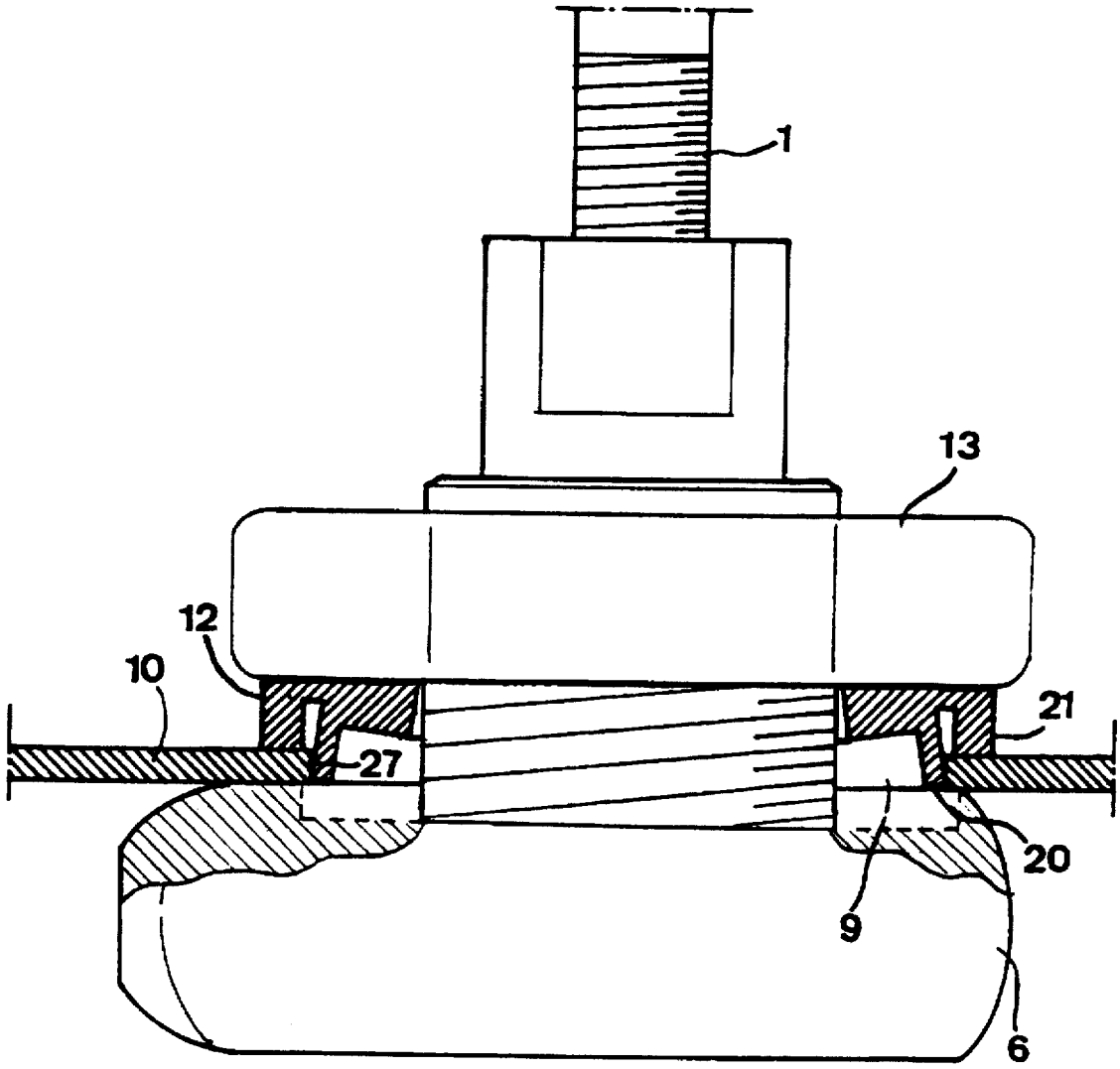
FIG. 5 is a view corresponding to FIG. 4 of the device in the state, in which said securing is completed.

Reference is now also made to the other figures. The element 1 is intended to be secured at a hole 9 in the metal plate 10 while establishing an electrical connection between its lower portion or ground portion 5 and the metal of the plate. For obtaining such securing the element 1 is intended to from one side of the plate, in the case of a car antenna from the interior of the car, be displaced through said hole 9 until the surfaces 7 of the first securing member 6 come into abutment upon surfaces of the metal plate 10 surrounding the hole 9. Through the elongated design of the member 6 this could also by inclining the element 1 be pushed through the hole 9 from the opposite direction. Then, at the same time as or possibly even before the obtention of said abutment of the first securing member 6, an annular means 12 having an inner central opening 11, here in the form of an expander washer, is threaded over the element 1 into the position shown in FIG. 4, in which it surrounds the lower portion 5 of the element. The construction of this annular means 12 will be described more in detail further on. A second securing member 13 in the form of a nut having an inner thread corresponding to the outer thread of the lower portion 5 is then screwed onto said lower portion 5, so that the two securing members 6 and 13 approach each other from both sides of the metal plate 10 so as to secure the element 1, i.e. indirectly the antenna, with respect to the metal plate. The annular means 12 will then function as an insert between the nut 13 and the metal plate 10, which appears from FIG. 2. With reference made in particular to FIG. 3–5 it will be explained further on how the nut 13 co-operates with the annular means 12 for securing the antenna securing element with respect to the plate while obtaining the grounding of the portion 5 required.

When grounded securing of the element 1 at the metal plate 10 has been obtained, a perforated protection cap 14 is brought over the element 1, so that it by lower surrounding support portions 15 comes to bear upon the metal plate 10, whereupon a nut 16 is brought onto the element 1 and tightened with respect thereto at the lower thread of the upper portion so as to achieve a tight bearing of the support portions 15 of the protection cap 14 against the metal plate 10 so as to prevent dirt, moisture and the like from penetrating into the interior of the protection cap 14 and thereby through the hole 9 reach the interior of the car. A further protection cap 17 is then screwed above the nut 16 onto the element 1 through the upper thread thereof, whereupon the mounting is completed and the state according to FIG. 2 is obtained.

How the grounding, i.e. the electrical connection between the metal of the metal plate and the element is obtained in connection with the securing will now be described with reference to FIGS. 3–5. The annular means 12 is made of a material having a good electrical conductivity. The annular means 12 is further so selected and so machined, respectively, that it is resilient, i.e. it stores potential energy upon deformation from an unstressed rest state, and it tends to use said energy so as to return to the initial rest position. The annular means has a conical portion 18, which extends from the outer edge 19 of the ring and to the central opening 11 and is intended to be directed in the direction towards the second securing member 13 (see the position according to FIG. 4) in the state in which it is applied around the element 1. With respect to the axis of the opening substantially axial first portions 20 in the form of an annular flange project from the conical annular portion in the direction of the first securing member 6. Substantially axial second portions 21 in the form of a second annular flange project from the conical portion 18 in the region of the outer edge 19 of the annular means 12 substantially parallelly to the first annular flange. The two annular flanges 20 and 21 are concentric with respect to the center axis of the central opening 11. The outer diameter of the first annular flange 20 is selected to be somewhat smaller than the diameter of the hole 9 in the metal plate 10, so that this annular flange may easily be introduced into said hole 9, whereas the outer diameter of the annular flange 21 is so selected that this annular flange will come into abutment on portions of the metal plate 10 directed axially with respect to the center axis of the hole and surrounding the hole when the annular means 12 is moved towards said hole 9. The annular flange 20 projects in the axial direction further than the annular flange 21, so that the former enters at least a bit into the hole 9 before the latter comes to bear against the metal plate.

A material saving or cut-out 22 extending substantially axially in the-direction of the cone surface of the conical portion is carried out between said first and second annular flanges 20, 21. Furthermore, slits 23 extending radially from said central opening 11 and distributed with the same angular space around the opening are arranged, which extend through the first flange ring 20 and divide this into a plurality, in the case shown eight, sections 24.

The function of the device just described, in particular with respect to the co-operation between the securing member 13 and the annular means 12 is as follows: the first 6 and the second 13 securing member are upon reaching the position according to FIG. 4 displaced towards each other by turning the nut 13 in the tightening direction. When the surface 20 of the first securing member 6 enters into contact with the metal plate and the nut 13 by the axially directed surface portions 25 thereof at the same time has entered into contact with the inner edge 26 of the conical portion 18 and the outer annular flange 21 bears against the metal plate 10, continued tightening of the nut 13 will cause successively, flattening of the conical portion 18 while applying axial forces to the inner edge 26 thereof, whereby these forces are transferred to a substantially radially directed movement of the annular flange sections 24, so that these come into abutment onto the circumferential wall 27 of the hole 9. The material saving 22 as well as the slits 23 facilitate the radial movement of the first annular flange 20, so that this can take place without any substantial deformation of the second annular flange 21. It is also of importance that the diameter of the opening 11 in the means 12 is somewhat greater than that of the lower portion 5 of the element. The tightening of the nut 13 is preferably continued until the position shown in FIG. 5 is reached, in which the conical portion 18, which initially makes an angle of about 85° with the center axis of the hole, has been completely flattened, so that this angle has become 90°. Thanks to the resiliency of the material forming the annular means 12 the radially directed parts of the annular flange 20 will bear under a preload against the circumferential wall 27, so that a very good and reliable contact is obtained between the annular flange 20 and the metal of the metal plate 10 exposed by the circumferential wall 27. In absence of said circumferential wall 27 the first annular flange 20 would in this position certainly move a little bit further in the radial direction.

The electrical connection between the element 1, i.e. the antenna securing element, and the metal of the metal plate, thus the grounding of the antenna securing element with respect to the metal plate, is here obtained by the radial abutment of the annular flange 20 of the annular means 12 on the circumferential wall 27 of the hole, the axial abutment of the annular means 12 on the nut 13 and the thread engagement thereof with the ground part or portion 5. The resiliency of the annular means 12 will then also give rise to a preloaded abutment of the portion 18 conical in the unloaded state of said means on the axial surface portions 25 of the nut 13. In the particular case of an antenna for a car telephone the resistance between the antenna and the ground, i.e. the body sheet of the car, may not exceed 0,4 Ohm, and this criterion is easily fulfilled by the device according to the invention.

It appears from FIGS. 1, 4 and 5 that the first securing member 6 has a countersink 28 around the lower portion 5 of the element. This countersink is arranged to enable the use of the device according to the invention for securing at holes in metal plates of varying thicknesses, so that in the case of a thinner metal plate than the one shown in the figures the first annular flange 20 will in the position according to FIGS. 2 and 5 project somewhat into said countersink 28.

The patent claim definition "displaced radially" comprises all types of movements having a radial direction component, so that it is then possible that the movement has also an axial direction component. The same discussion is valid for the definition "radial abutment", which accordingly means that the abutment takes place in a direction having a radial component.

The invention is of course not in any way restricted to the preferred embodiments described above, but several possibilities to modifications thereof would be apparent to a man skilled in the art, without departing from the basic idea of the invention.

It would for example be well possible to almost arbitrarily change the shapes of the cross section of the hole, the element and also the means for obtaining the electrical connection between the plate and the element. Although a round cross section shape seems to be most suitable, especially for achieving a symmetrical force distribution, it would be well possible to provide the hole with a cross section being triangular, rectangular or shaping it in another way if desired.

The means could be designed to be influenced in radial direction by an axial action of the second securing member in another way than by providing a conical portion of the means, for example by providing mutually co-operating wedge surfaces on on one hand the securing member and on the other the annular member, wherein the wedge-shaped member of the securing means would then be regarded as a part of said means.

It would of course be well possible to arrange said means establishing an electrical connection on the same side of the metal plate as the first immobile securing member. It would also be well possible to arrange both securing members movable with respect to the element, wherein such a movement does not necessarily have to be dependent on a turning movement with respect to a thread, but also other tightening devices than a thread engagement would be conceivable.

I claim:

1. A device for grounded securing of an element (1) at a hole (9) in a metal plate (10) comprising:

members (6, 13) movable on both sides of the plate towards each other and the plate for securing the element to the plate and means (12) adapted to establish an electrical connection between the metal plate and the element, said means (12) being arranged to enter into radial abutment on the circumferential wall (27) of the hole while establishing said electrical connection, said means (12) comprising at least one flange portion (20) arranged to be displaced radially outwardly within said hole (9) into abutment on the circumferential wall (27) of the hole; wherein said means (12) are arranged to enter into said abutment for electrical contact by said moving of the seeming means (6, 13) in a direction towards each other.

2. A device according to claim 1 wherein said means (12) are adapted to enter into a preloaded abutment onto said circumferential wall (27).

3. A device according to claim 2 wherein at least a part of said means (12) is deformable from an initial shape in an unstressed state into a deformed shape while storing potential energy on establishing said abutment.

4. A device according to claim 3 wherein at least a part of said means (12) is made of resilient material.

5. A device according to claim 1 wherein said means (12) is adapted, upon moving the securing members (6, 13) towards each other, to be urged by at least one (13) of said members in the axial direction of the hole (9) and thus cause radial displacement of said flange portion (20) of the means (12) located in the hole.

6. A device according to claim 1 wherein said means (12) comprises a ring having a central opening (11) for receiving a portion of the element (1).

7. A device according to claim 1 further comprising an externally threaded member (5) arranged to be pushed into said hole (9) of the plate (10), and that one of the securing members (13) is a nut for receiving said threaded member and turnable therearound for said securing.

8. A device according to claim 1 wherein said means (12) are arranged to establish said electrical connection by interposedly bearing against the metal plate (10) and one of the securing members (13) so as to establish an electrical connection between said means (12) and the element (1).

9. A device according to claim 1 wherein the element (1) is arranged to receive an antenna for receiving radio waves.

10. A device according to claim 1 wherein the plate (10) is a body panel of a car.

11. A device according to claim 1 the element (1) includes a mounting piece connected thereto and the means (12) comprises a ring having a central opening (11) therein for receiving the mounting piece.

12. A device for grounded securing of an element (1) at a hole (9) in a metal plate (10) comprising:

members (6, 13) movable on both sides of the plate towards each other and the plate for securing the element to the plate;

means (12) adapted to establish an electrical connection between the metal plate and the element, said means (12) being arranged to enter into radial abutment on the circumferential wall (27) of the hole while establishing said electrical connection, said means (12) comprising at least one flange portion (20) arranged to be displaced radially within said hole (9) into abutment on the circumferential wall (27) of the hole;

said means (12) is adapted, upon moving the securing members (6, 13) towards each other, to be urged by at least one (13) of said members in the axial direction of the hole (9) and thus cause radial displacement of one of said flange portion (20) of the means (12) located in the hole;

said means (12) comprising a portion (18) being conical in an unloaded state and adapted to be arranged coaxially with respect to the hole (9) of the plate (10), the concical portion (18) is provided with a central opening (11) at the tip thereof and converges from the hole of the plate towards said one securing member (13);

the at least one flange portion including a substantially axial first flange portion (20) integral with the conical portion and projecting into the hole of the plate and a second flange portion (21) facing the plate adjacent said hole, and that the means is arranged, upon moving said one securing member (13) towards the plate, by bearing against the conical portion (18) adjacent the central opening (11), to press said second portion (21) into abutment upon the plate (10) and by continued pressing causing the first flange (20) to be displaced radially in the hole and into abutment upon the circumferential wall (27) thereof by at least partially flattening the conical portion (18).

13. A device according to claim 12 wherein the cone surface of the conical portion makes an angle greater than 80°, with the center axis of the hole.

14. A device according to claim 13 wherein the cone surface of the conical portion makes an angle between approximately 83°–87° with the center axis of the hole.

15. A device according to claim 12 wherein the means (12) comprises first and second flange portions and a recess (22) formed between said first (20) and second (21) flange portions and extending substantially axially in the direction of the cone surface of the conical portion.

16. A device according to claim 12, wherein said first and second flange portions include a first and a second annular flange (20, 21) concentric with respect to each other and to the hole, wherein in the unloaded state of said means the outer diameter of the first annular flange (20) is at least as large as the hole.

17. A device according to claim 12 wherein a plurality of slits (21) extend from said central opening (11) outwardly into the conical portion (18) so as to divide the conical portion into a plurality of sections (24) around the central opening.

18. A device according to claim 17 wherein the slits (23) extend into and through the first flange portion (20) for dividing the first flange portion into a plurality of sections (24) around the central opening (11).

19. A device according to claim 17 wherein the slits (23) extend radially and are uniformly distributed around the central opening (11).

* * * * *